United States Patent [19]

Bohinc et al.

[11] 4,093,837

[45] June 6, 1978

[54] OIL CIRCUIT-BREAKER PUMP-ASSEMBLY WITH IMPROVED SHUNTING CONTACT STRUCTURE

[75] Inventors: Richard J. Bohinc, Hempfield Township, Westmoreland County; Charles W. Tragesser, Murrysville, Westmoreland County; Ronald E. Vaill, Penn Township, Westmoreland County; Francis R. Racki, O'Hara Township, Allegheny County, all of Pa.

[73] Assignee: Westinghouse Electric Corp., Pittsburgh, Pa.

[21] Appl. No.: 600,556

[22] Filed: Jul. 31, 1975

[51] Int. Cl.[2] ..... H01H 33/92

[52] U.S. Cl. ..... 200/150 G; 200/150 R; 200/34

[58] Field of Search ..... 200/150 G, 150 E, 150 R, 200/34

[56] References Cited

U.S. PATENT DOCUMENTS

| | | | |
|---|---|---|---|
| 2,258,226 | 10/1941 | Skeats | 200/150 G |
| 2,271,989 | 2/1942 | Prince | 200/150 G |
| 2,389,856 | 11/1945 | Jones | 200/34 |
| 2,422,569 | 6/1947 | Leeds | 200/150 E |
| 2,452,762 | 11/1948 | Karow | 200/34 |
| 2,459,599 | 1/1949 | Strom | 200/150 G |
| 2,606,262 | 8/1952 | Bartlett | 200/150 G |
| 2,703,828 | 3/1955 | Cushing | 200/34 |
| 2,749,412 | 6/1956 | McBride et al. | 200/150 G |
| 2,775,670 | 12/1956 | Geiger, Jr. | 200/34 |
| 3,393,285 | 7/1968 | Harper | 200/150 G |
| 3,655,935 | 4/1972 | Houben | 200/34 |
| 3,819,893 | 6/1974 | Jawelak et al. | 200/150 G |

*Primary Examiner*—Robert S. Macon
*Attorney, Agent, or Firm*—W. R. Crout

[57] ABSTRACT

An improved oil-pumping piston-assembly is provided for an oil-type circuit-interrupter to improve the interrupting performance during low-current conditions, having an improved hydraulic-dashpot action occurring during charging and discharging oil, incorporating, additionally, a "floating" piston design, and reducing the mechanical impulse forces exerted on the cylinder when high-current interruptions are made with an improved check-valve construction.

The improved oil-pumping piston-assembly of the present invention is particularly adapted for the inclusion therewith of an auxiliary shunting separable-contact structure, which will, when desired, increase the current-carrying capability of the circuit-interrupter. Its inclusion, or exclusion, is optional, depending upon the current rating desired by the utility customer.

Also, the improved oil-pumping piston-assembly provides an improved check-valve construction, which will admit clean oil into the pumping cylinder from the clean-oil region externally of the grid structure, by an improved check-valve structure located at a position between the pumping-cylinder reservoir and the lower end of the pumping housing, through which oil inlet passages are provided for the entrance of such clean oil into the pumping cylinder.

7 Claims, 6 Drawing Figures

CLOSED POSITION 11
16
1
52
35
55
9
36
37
34
38
59
27
32
A
46
18
56
31
32
7
40
40a
34
42
20
44
13
48
33
49
24
26
17
R

ARCING POSITION,
MAIN CONTACTS OPEN

OPEN POSITION OF
MAIN CONTACTS

OIL CIRCUIT-BREAKER PUMP-ASSEMBLY WITH IMPROVED SHUNTING CONTACT STRUCTURE

CROSS-REFERENCES TO RELATED APPLICATIONS

Applicants are not aware of any related patent applications pertinent to the present invention.

BACKGROUND OF THE INVENTION

In U.S. Pat. No. 3,819,893, issued June 25, 1974, to Jawelak et al, there is set forth an oil-type circuit-breaker having a laterally-disposed oil-pumping cylinder with improved auxiliary shunting contacts for increased current-carrying ability. The function of the oil pump in the aforesaid Jawelak patent is to improve the circuit-breaker performance during low-current interruption, when inadequate pressures may develop, or be generated within the oil-grid structure during such low-current interruption, and an auxiliary, supplementary flow of oil under pressure is desirable to engage the arc, which is established to effect its extinction. In addition, the foresaid patent teaches the concept, broadly, of a shunting contact structure to provide two electrically-parallel separate pairs of separable contacts acting collectively to increase the current rating capability of the circuit-breaker in the closed-circuit position. This enables high current ratings to be applicable, or assigned to the circuit-breaker.

SUMMARY OF THE INVENTION

According to the present invention, an improved pump-assembly is provided for an oil-type circuit-interrupter, in which the piston assembly is designed to take advantage of the fact that the whole piston assembly is submerged in oil by having a dashpot action present during the opening and closing operations. Additionally, the piston is isolated from the piston-rod with resilient material, which allows for smooth reliable operation at all times, even if some misalignment exists.

Also, an improved check-valve construction is utilized to recharge the pumping assembly with clean oil from the region externally of the grid structure, as it communicates to the outside of the interrupter for oil replenishment. When the piston is going closed, the valve lifts off of the oil-inlet holes to thereby allow the clean, uncontaminated oil to enter the pumping cylinder. When the piston is traveling open, the aforesaid valve is now forced down by the oil pressure below the piston, and thus closes the oil communication holes to allow the oil to flow into the interrupter, and not back through the inlet holes.

Finally, the pump location is critical to the interrupter performance, when a small tank is utilized, and the present invention provides an improved location for the pump assembly. Also, an improved shunting contact structure is provided to increase the current capability of the circuit-breaker.

The improved pumping-assembly of the present invention is readily adaptable, where desired, for increasing the current capability of the circuit-interrupter for accommodating a second separable pair of auxiliary main contacts, which will, collectively, with the separable arcing contacts greatly increase the current-carrying capacity of the device. These auxiliary main contacts may be included, or left off of the interrupter as desired.

DESCRIPTION OF THE PREFERRED EMBODIMENT

Figure 1:
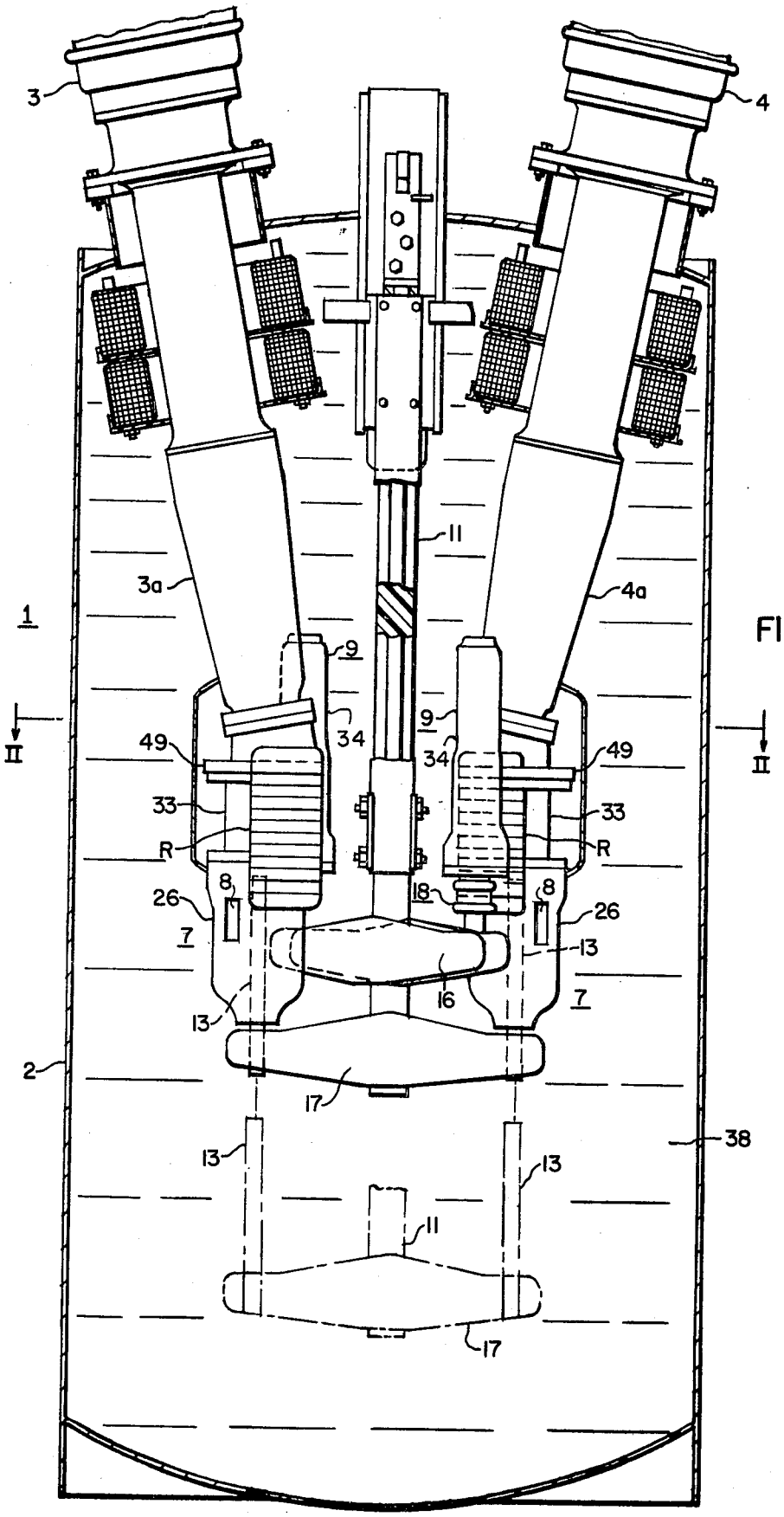
FIG. 1 is a side-elevational view, in section, of an oil-type circuit-interrupter embodying the principles of the present invention with the interrupter being shown in the fully-closed position.
Figure 2:
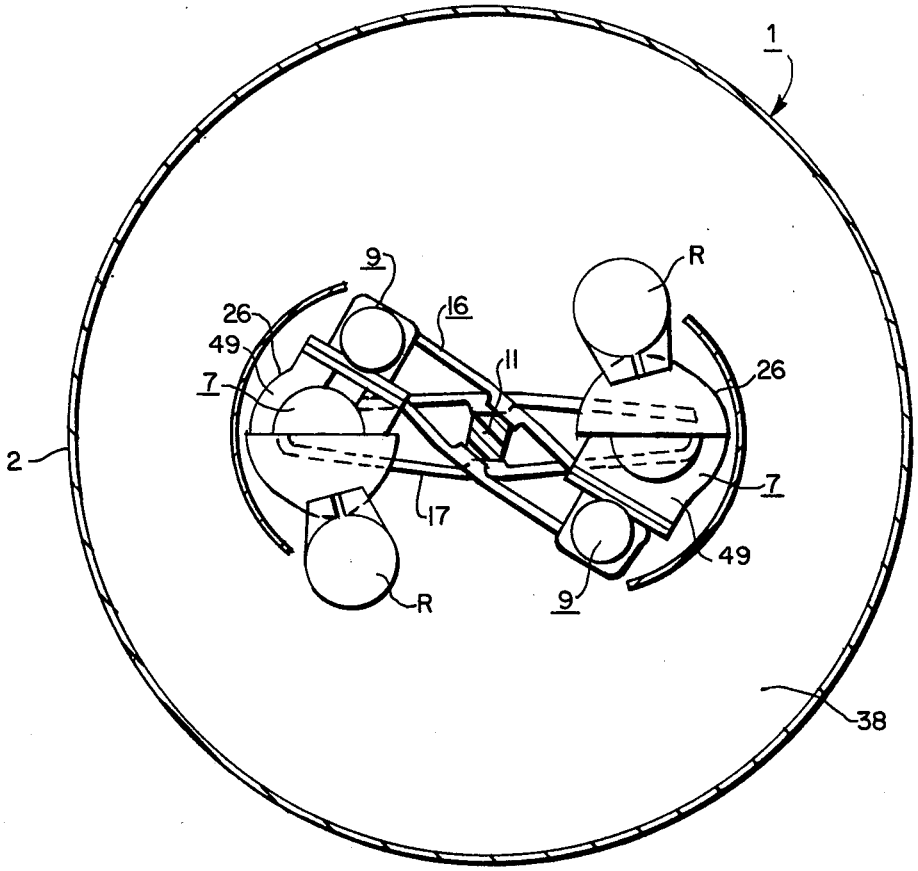
FIG. 2 is an enlarged sectional plan view of the improved pump-assembly and grid structure in the closed-circuit position.

Referring to the drawings, and more particularly to FIG. 1 thereof, the reference numeral 1 designates an oil-type circuit-breaker, including a tank structure 2, into which extend a pair of laterally-spaced terminal-bushings 3 and 4. At the lower ends 3*a*, 4*a* of the terminal-bushings, 3,4 are secured a pair of interrupters, or grid structures 7, each of which has a laterally-disposed oil-pumping assembly 9 secured thereto, as more clearly illustrated in FIGS. 2 and 3 of the drawings.

As well known by those skilled in the art, a suitable operating mechanism, constituting no part of the present invention, is provided to effect vertical upward closing motion of an insulating lift-rod assembly 11, and downward opening motion of the same. This simultaneously effects downward opening motion of a main cross-arm 17 having attached therewith a pair of movable arcing contact rods 13 and also additionally, a cross-arm assembly 16, the latter carrying a pair of movable auxiliary main contacts 18 therewith.

As set forth in U.S. Pat. No. 3,356,811, issued Dec. 5, 1967 to Cushing et al, and as well known by those skilled in the art, the separation of each movable arcing contact 13 from its respective stationary cluster finger-assembly 20 establishes arcing conditions within the individual grid structure 7. The grid structure 7 may, for example, comprise a plurality of stacked insulating plates 24 having suitable inlet passages and venting passages therein, venting externally of the insulating casing 26, so that oil 38 under pressure effects extinction of the arc 29 (FIG. 5).

During relatively low-current interruption, the oil pressure, generated within the grid structure 7, is inadequate, and, as is customary in this art, an auxiliary piston-pumping device 9 provides an auxiliary oil flow to assist in increasing the pressure directed at the arc 29, and thereby causing oil flow into the arc 29 to effect its extinction. See U.S. Pat. No. 2,606,262 Bartlet in this connection.

Figure 3:
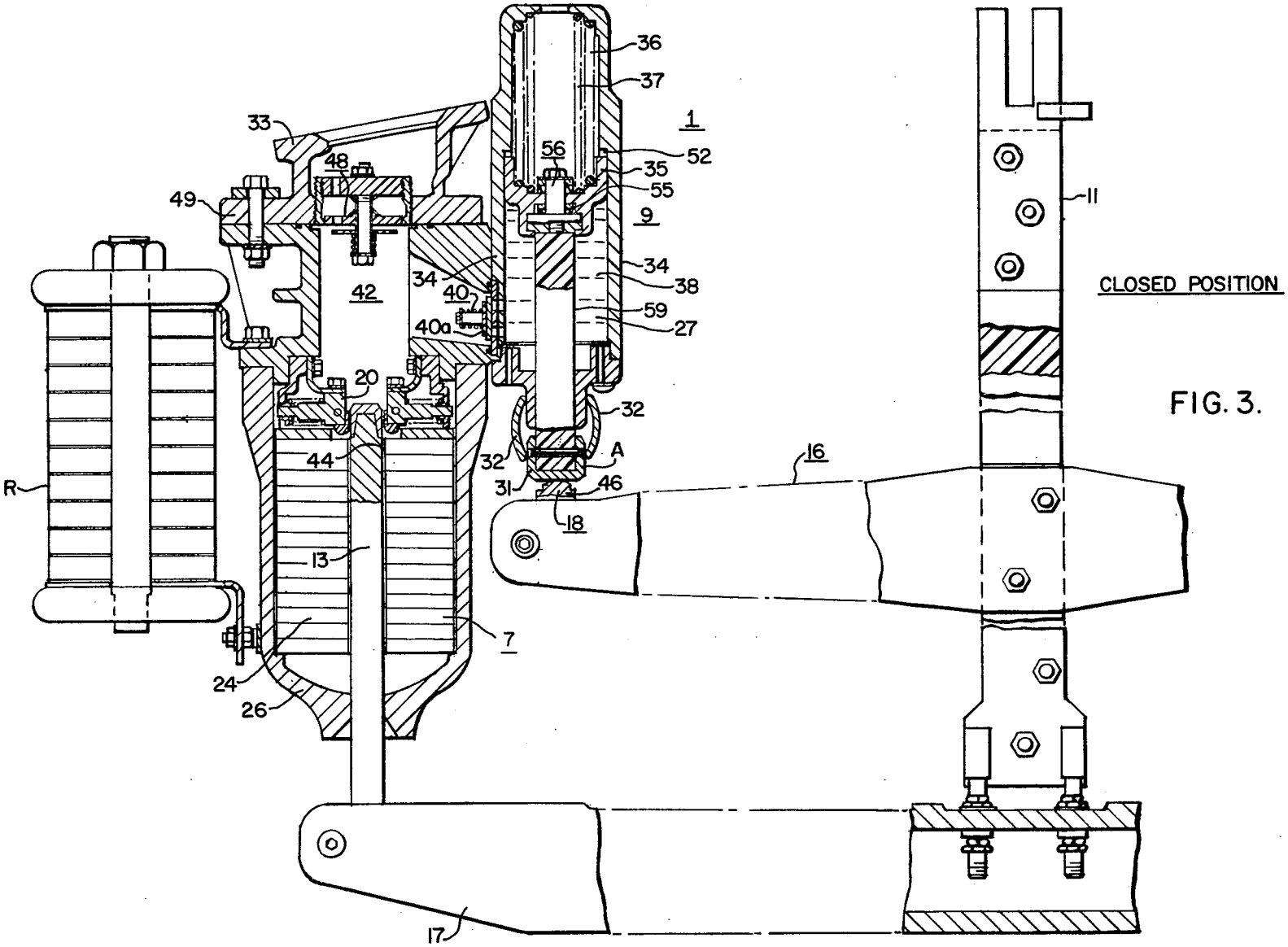
FIG. 3 illustrates, to an enlarged scale, the circuit-breaker of FIG. 2 in the closed-circuit position with the separable arcing contacts closed and also the main contacts closed.
Figure 5:
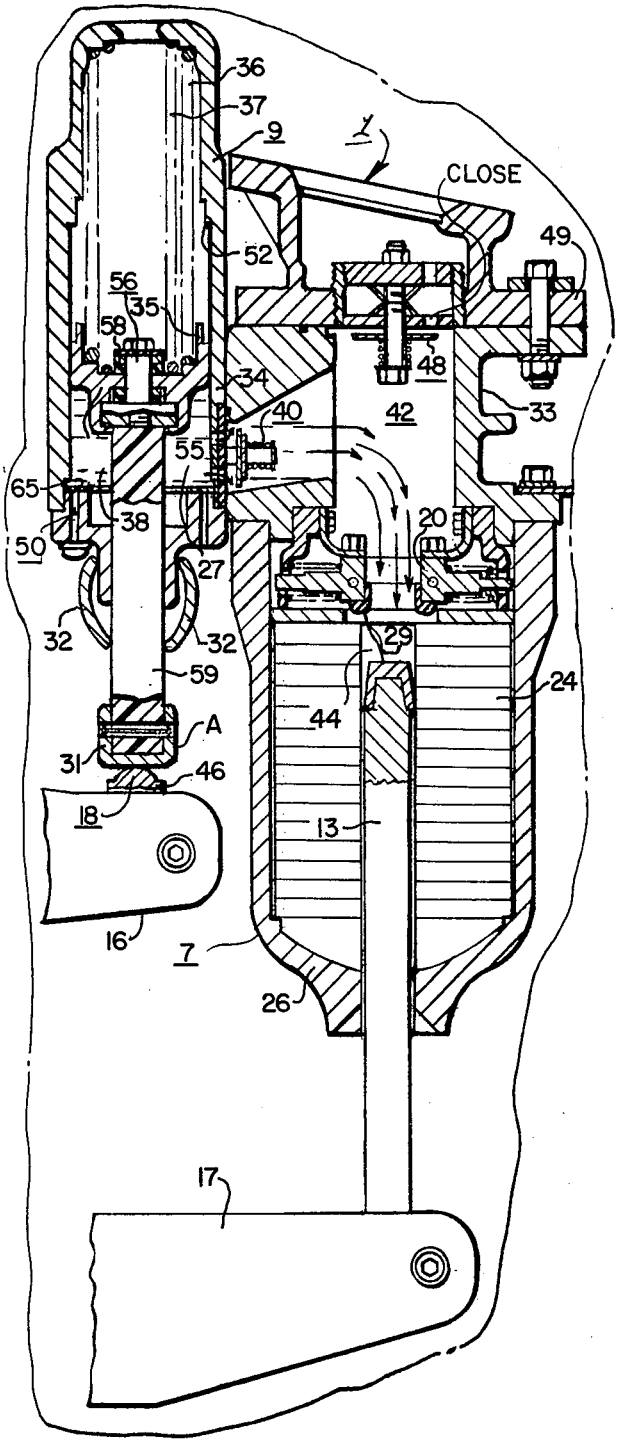
FIG. 5 is a fragmentary vertical sectional view taken through both the grid and pump assemblies illustrating the arcing position of the separable grid contacts and the oil pumping flow action.

FIGS. 3 and 5 more clearly show the arrangement of the oil-pump assembly 9 and the grid structure 7, with FIG. 3 illustrating the device in the closed-circuit position, and FIG. 5 illustrating a partially open-circuit arcing condition, wherein the main auxiliary separable contacts 31 and 32 are separated, and yet the current flow passes across the separable arcing contacts 13 and 20, which have an arc 29 established therebetween at this time due to their separation.

Figure 4:
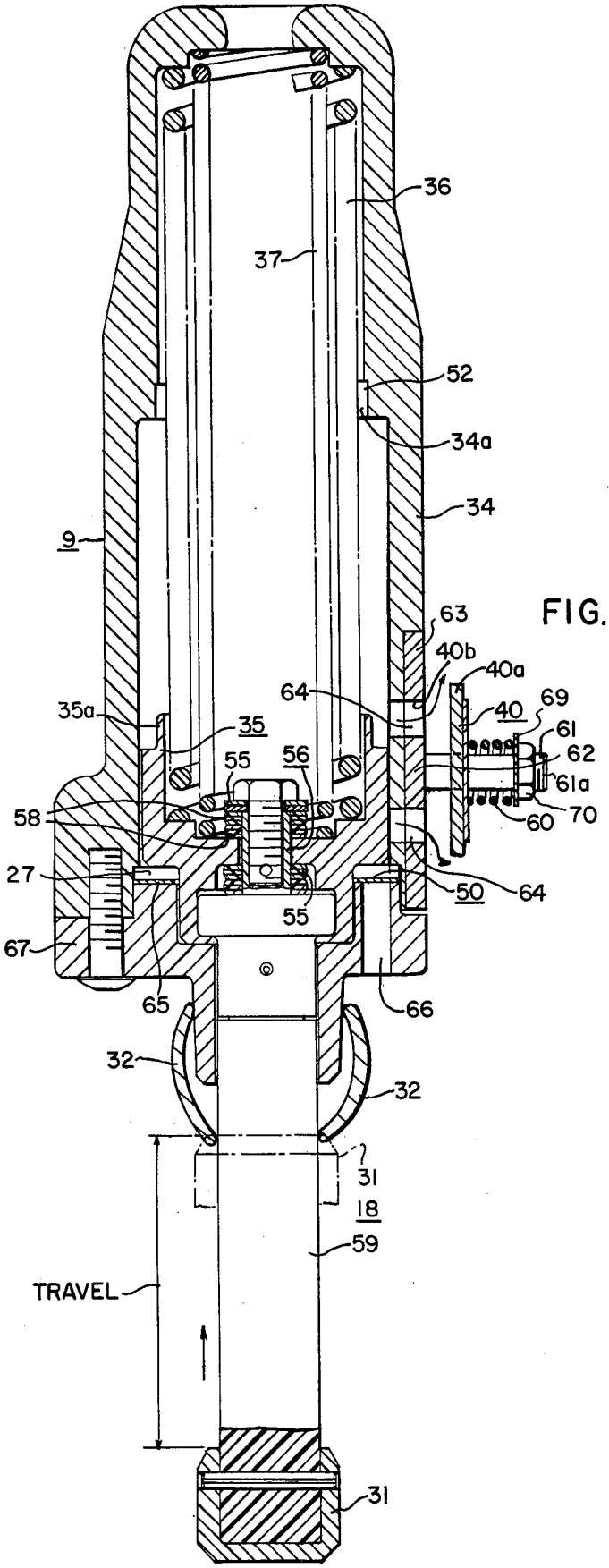
FIG. 4 is an enlarged view of the improved pump assembly with the piston therein shown in its discharged position.

FIG. 4 illustrates a later condition of the pump assembly 9, in which the auxiliary main contact structure 18 is in the fully open separated position. The pump assembly 9 is now ready for the closing operation of the circuit interrupter 1.

As illustrated in FIG. 3, it will be observed that there is provided an upper housing casting member 33, which has bolted thereto, to one side thereof, the oil-pumping assembly 9 comprising a pumping cylinder 34, within which vertically moves an oil piston 35. Suitable springs, such as a battery of compression springs 36 and 37, effect a downward biasing action upon the movable pump piston 35 within the oil cylinder 34 to force a flow of oil 38, when permitted by the pressure conditions within the grid structure 7, through the check-valve assembly 40, and into the main body of oil in the reservoir portion 42 of the grid structure 7. In this latter region 42, the oil 38 will flow downwardly through the generally hollow stationary contact structure 20, and into the arcing region 44 (FIG. 5) to ultimately vent out through the lateral vents in the plate structure 24 (not shown) and externally of the grid structure 7 out through vent openings 8 (FIG. 1).

Figure 6:
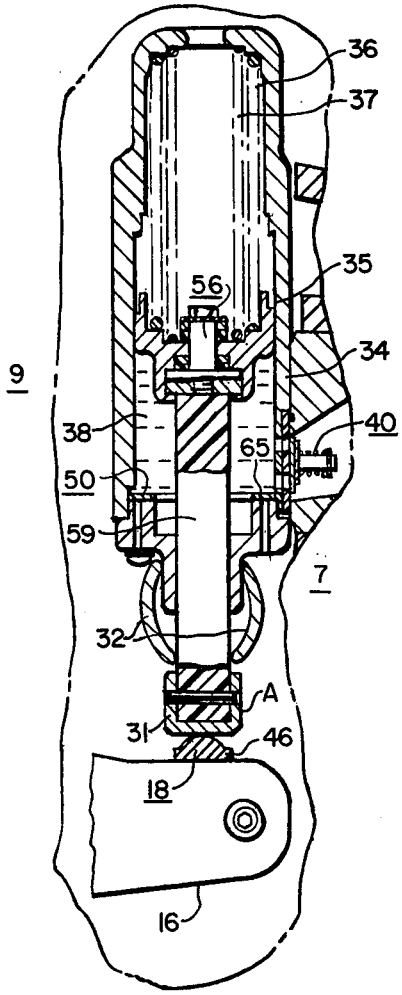
FIG. 6 is a fragmentary vertical sectional view of the pump assembly per se illustrating the main contacts thereof open and also the pressure conditions within the grid assembly maintaining the pump check-valve in the closed position.

The grid structure 7 is such that during the initial portion of the opening operation, the lower movable main tip contact 31 of the auxiliary main shunting contact structure 18 moves downwardly away from the stationary main cluster-finger contacts 32 to part company therewith and to open the circuit thereof. However, during this time, as illustrated in FIG. 6, the separable arcing contacts 13, 20 therethrough (not shown) are still closed within the grid structure 7, so that current flow continues to flow, but only through the arcing contacts 13, 20 within the grid structure 7, and not at the laterally-disposed auxiliary main separable contacts 31 and 32. In more detail, downward opening movement of the auxiliary main cross-bar 16 (FIG. 2) causes simultaneously downward movement of the movable main auxiliary contact projection 46 secured thereto, which enables the compression springs 36, 37, located within the pumping cylinder 34, to force the lower movable main cap contact 31 downwardly, parting company with the stationary main contact fingers 32, and opening the auxiliary parallel electrical circuit therethrough, as illustrated in FIG. 6.

At a subsequent point in time, the separable arcing contacts 13, 20, will part company within the grid structure 7 generating pressure therein, and effecting closure of the check-valve 48 disposed at the upper end of the casting structure 33. As shown in FIG. 3, the upper casting structure 33, generally, comprises a top casting plate 49, within which is threadedly secured, for example, the upper check-valve assembly 48, which permits a circulation of oil within the oil-storage region 42 during the closed-circuit position of the device 1. During arcing conditions, however, pressure conditions, existing within the reservoir chamber 42, are such as to effect a quick closure of the upper check-valve assembly 48 to thereby maintain the high oil pressure conditions, which is desirable to effect oil flow under pressure down through the established arc 29 and through the lower-disposed insulating plate assembly 24 to effect arc extinction.

With reference of FIG. 4, it will be observed that there is provided a dashpot 50 disposed at the lower end of the pumping cylinder 34, which cushions the downward opening operation of the movable piston assembly 35. In addition, there is provided a dashpot action 52 at the upper end of the operating cylinder 34, so that during the closing operation an additional cushioning dashpot action 52 is present. Also, a resilient connection 55 (FIG. 4) is provided between the piston-stem 56 and the moving piston 35 itself by the interposition of a plurality of neoprene, or elastomeric washers 58, which, for example, may comprise four in number. This provides a desired flexibility of alignment between the piston-stem 56 and the moving piston assembly 35 itself.

To increase the current capability of the device, it will be observed that there is provided the lower main auxiliary contact 31, which makes engagement with the stationary main auxiliary contacts 32 to additionally assist the arcing contacts 13, 20 to carry high current ratings through the device 1. This obviously increases the current-carrying capability of the device for the higher-current ratings. However, it is to be clearly understood that where lower-current-rating breakers 1 are involved, the contact structure 18 may be eliminated, and merely the projection 46 is utilized to effect charging of the piston-stem 56 and piston assembly 35 with the auxiliary main contact structure 18 eliminated.

Generally, the piston-stem 56 comprises an insulating piston-rod 59, which makes abutting engagement with the movable projection 46 affixed at the end extremity of the auxiliary cross-arm 16, so that charging of the pump assembly 9 occurs during the closing operation of the circuit-breaker 1, and during the opening operation, the movable projection 46 permits a downward biasing action by the battery of compression springs 36, 37 to effect downward oil-driving action of the piston 35 within the piston cylinder 34. A laterally-disposed one-way-action check-valve 40 is provided so that whether or not oil 38 enters from the piston cylinder 34 into the storage region 42 depends upon the pressure conditions present. If these pressure conditions are high, as occurs during high-current interruption, the check-valve 40 will remain closed, and the piston assembly 35 will be stalled. At a subsequent point in time, the arc 29 will be extinguished, the pressure conditions within reservoir chamber 42 will die down, and then the check-valve 40, at this point in time, will open to permit a flushing circulation of oil from the pump assembly 9 into the grid structure 7 to clean out residual arc products and contaminated oil.

The check-valve assembly 40 is more clearly illustrated in FIG. 4. It will be noted that, generally, there is provided a movable check-valve plate 40*a*, biased to the closed valve position over the valve opening 40*b* by a compression spring 60. A bolt 61 threads into the center portion 62 of a check-valve mounting plate 63, and supports a washer 69, upon which the compression spring 60 seats at its left-hand extremity. The right-hand end of the compression spring 60, as viewed in FIG. 4, seats against a stationary washer 69 held by a nut 70 threaded onto a threaded portion 61*a* of the valve stud 61. Thus, during low-pressure conditions existing within the grid structure 7, the check-valve plate 402 will open to permit a flow of oil out of the region 27 of the pumping cylinder 34 and into the oil storage region 42 within the grid structure 7.

During the closing operation, the cross-arm 17 moves upwardly carrying therewith the movable arcing contacts 13, which effect closing engagement with the stationary arcing contacts 20 prior in point of time to the subsequent contact closure of the movable main contact projection 31 with the lower end of the stationary cluster fingers 32, which finally close to assist in the increase of the current-carrying capability of the device. This has the advantage that no arcing occurs whatsoever during opening or closing operations at the auxiliary separable main contacts 31 and 32.

From the foregoing, it will be apparent that the piston 35 is designed to take advantage of the fact that the whole piston assembly 9 is submerged in oil. The top section 35*a* is machined with an offset, which, when the circuit-breaker is closed, fits inside the dash pot cylinder 34*a* machined into the interior of the pump housing 34. The tolerances are such that the piston 35 gently decelerates to the closed position without damage. The same can be said when the piston 35 is driven open, that is downwardly.

Also, it will be observed that the piston 35 is isolated with resilient material 55 from the piston-rod 59. This allows for smooth reliable operation at all times, even if some misalignment existed. This also reduces the impact loading upon the piston-rod 59 and rod-end projection 31 during operation.

The one-way-acting check-valve 50 is used to recharge the pumping assembly reservoir 27 with clean oil, as it communicates to the outside 28 of the interrupter 1 for oil-replenishment. When the moving piston 35 is going closed, that is upwardly, the valve plate 65 of the check-valve 50 lifts off the oil-inlet holes 66 in the lower closure plate 67 to allow the oil to enter upwardly into the pumping cylinder reservoir 27. When the piston 35 is traveling open, that is downwardly, the valve plate 65 of the check-valve assembly 50 is forced down by the oil pressure in the piston-compression region 27 below the piston 35, and closes the oil-communication holes 66 to force the oil to flow into the interrupter region 42 for extinguishing purposes, and not out downwardly through the valve inlet holes 66.

When the circuit-breaker 1 is applied for, say, for example, 3,000 amperes continuous current duty, the auxiliary contacts 18 may be eliminated; but when 4,000 amperes current rating is required, the side finger main contact assembly 18, involving the cluster of main stationary contacts 32, with the lower end main movable contact tip 31 is provided, thereby providing an auxiliary electrically-parallel augmenting current path through the interrupter 1 and through the auxiliary cross-arm 16.

When the circuit-breaker 1 is moving downwardly to the open position, the auxiliary cross-arm 16 and the main cross-arm 17 move downwardly together. The stationary main finger assembly 32, which engages the lower movable main end cap 31, now slides off the lower main end cap 31, and rides upon the insulated pumping piston rod 59. This breaks the auxiliary main current path and transfers the main current to the current flow path through the separable arcing contacts 13, 20 disposed within the grid structure 7, since the arcing contacts 13 and 20 are still contactingly engaged at this time. As the breaker 1 continues to open, the arcing contacts 13, 20 separate, and an arc 29 is drawn between them within the grid structure 24, as shown in FIG. 5, where arc interruption occurs by an oil flow under pressure. This procedure enables the arcing 29 to take place within the interrupting grid structure 24 and not externally thereof.

When closing the circuit-breaker, the reverse sequence is true. The arcing contacts 13, 20 make contacting engagement first, and, subsequently, the auxiliary externally-located main movable contacts 31 make contact with the main stationary contact fingers 32, thus preventing any arcing externally of the grid structure 7 due to pre-striking during the closing operation.

Thus, the device 1 has the capability of 4,000 amperes continuous current rating by means of utilization of the auxiliary cross-arm 16, which, desirably, provides an external parallel main current path outside of the grid structure 7 with the interiorly-disposed arcing contacts 13, 20, when such a higher current rating is desired.

Although there has been illustrated and described a specific structure, it is to be clearly understood that the same was merely for the purpose of illustration, and that changes and modifications may readily be made therein by those skilled in the art, without departing from the spirit and scope of the invention.

What is claimed is:

1. The combination in an oil-type circuit-interrupter of an arcing-grid structure having an adjacently-disposed oil-pumping piston-assembly, said arcing grid structure having a pair of separable arcing contacts (13, 20) disposed therewithin, said oil pumping-assembly including an operating cylinder and a movable oil-driving rigid piston slidable within said operating cylinder, said movable rigid oil-driving piston having an enlarged central aperature provided therein, a rigid piston rod for driving said piston and actuated externally of the oil-pumping piston assembly, said piston rod extending with clearance through the enlarged hole provided in the rigid movable piston, and a resilient connection provided between the rigid piston-rod and the movable rigid piston including one or more resilient washers surrounding said rigid piston rod and disposed on both sides of said enlarged hole in the piston for accommodating misalignment between the bore in the surrounding operating cylinder and the movable rigid piston for uninhibited smooth circuit-breaker operation.

2. The combination according to claim 1, wherein at least one neoprene washer is provided in said resilient connection.

3. An oil-type circuit-interrupter including a main oil grid structure having a pair of separable arcing contacts disposed therewithin, means defining an adjacently-disposed oil pumping-cylinder assembly with an open upper end and having a movable oil-pumping piston reciprocally operable therein, means simultaneously providing a closing of said separable arcing contacts with a charging action of the laterally-disposed open-ended oil pumping cylinder assembly and upward charging movement of the movable oil-pumping piston therein, and an annular cushioning oil dashpot provided in the casing wall at the upper end of the open-ended oil pumping cylinder assembly to thereby cushion the closing charging motion of the movable oil-pumping piston within the open-ended oil-pumping cylinder assembly.

4. The combination in an oil-type circuit-interrupter of an oil-type arcing grid structure having an adjacently-disposed oil-pumping piston assembly, said oil-type arcing grid structure having a pair of separable arcing contacts (13,20) disposed therewithin, said oil pumping assembly including a movable rigid oil-pumping piston slidable within a surrounding rigid operating cylinder and having a central enlarged aperature provided therewithin, a rigid piston rod for driving said piston and actuated externally of the oil-pumping piston assembly, said piston rod extending with clearance through the enlarged hole provided in the rigid movable piston, a pair of separable main auxiliary contacts comprising a stationary main contact (32) disposed adjacent the lower end of the oil-pumping cylinder and a movable main auxiliary contact (31) affixed to the lower end of the movable piston-rod, means for simultaneously effecting a closing operation of the movable arcing contacts (13,20) within the oil-type grid structure and a concomitant charging of the oil-pumping cylinder and movable piston therein and also a contacting engagement between the auxiliary main separable contacts (31,32), and a resilient interconnection comprising washers disposed about the piston rod on both sides of said aperature for accommodating misalignment between the movable piston-rod and the bore provided in the operating cylinder for smooth, uninhibited circuit-breaker pumping operation.

5. An oil-type circuit-interrupter including means defining a main grid interrupting structure (7) having a pair of separable arcing contacts disposed therewithin, means defining an adjacently-disposed stationary pumping cylinder (34) having a movable pumping piston (35) disposed therein, oil-conduit means (64) interconnecting the oil-piston region (27) below the movable pumping piston (35) with the oil region (42) within the main grid interrupting structure (7), said stationary pumping cylinder (34) defining a bore within which said movable pumping piston (35) reciprocally operates, said oil-conduit means being disposed adjacent the lower end of said stationary bore but leaving an annular oil-dashpot region (27) disposed below the oil-conduit means (64) and upwardly of the lower closed end of the stationary pumping cylinder (34), whereby during the opening operation of the movable oil-pumping piston (35) the oil-pumping piston (35) will move below said lower disposed oil-conduit means (64) and trap oil within said annular region (27) below said oil-conduit means (64) for desirable oil-dashpot cushioning action at the end of the downward opening operation of the movable oil-pumping piston (35).

6. The combination according to claim 5, wherein the stationary pumping cylinder (34) has its upper end open and freely communicating to the ambient externally of the grid interrupting structure, and wherein the upper inner wall of said stationary bore is provided with an upper offset portion (34*a*), and said movable oil-pumping piston (35) additionally is provided with a movable annular outer-disposed sleeve-portion (35*a*) which is directed upwardly away from the upper working piston face of said movable oil-pumping piston (35), whereby during the closing upward charging motion of the movable oil-pumping piston, a desirable oil-dashpot action (52) is provided by the trapped oil disposed within said upper offset piston (34*a*) and confined by said movable upwardly-directed sleeve-portion (35*a*) of the movable oil-pumping piston (35).

7. The combination according to claim 5, wherein a check-valve assembly (66) is disposed adjacent the lower end of the stationary pumping cylinder (34) for the entrance of clean oil upwardly therein during the upward closing charging movement of the movable oil-pumping piston (35), and said check-valve assembly (66) closing on the downward pressure-working stroke of said movable oil-pumping piston (35).

* * * * *